US005704223A

United States Patent [19]

MacPherson et al.

[11] Patent Number: 5,704,223

[45] Date of Patent: Jan. 6, 1998

[54] THERMOELECTRIC MEDICINE COOLING BAG

[75] Inventors: Edward Taylor MacPherson, Venice, Fla.; Clifford A. Bridges, Rye, N.H.; Richard K. Peters, Tallmadge, Ohio

[73] Assignees: Emerging Technology Systems, L.L.C., Akron, Ohio; Empower Technologies, L.L.C., Hampton, N.H.

[21] Appl. No.: 674,686

[22] Filed: Jul. 2, 1996

[51] Int. Cl.[6] ..... F25B 21/02

[52] U.S. Cl. ..... 62/3.62; 62/457.9

[58] Field of Search ..... 62/3.2, 3.6, 3.62, 62/371, 457.9

[56] References Cited

U.S. PATENT DOCUMENTS

| | | | |
|---|---|---|---|
| 3,148,515 | 9/1964 | Jentis et al. . | |
| 3,713,302 | 1/1973 | Reviel . | |
| 4,250,998 | 2/1981 | Taylor | 206/570 |
| 4,322,954 | 4/1982 | Scheehan et al. | 62/371 |
| 4,364,234 | 12/1982 | Reed | 62/3.6 |
| 4,368,819 | 1/1983 | Durham | 206/545 |
| 4,377,077 | 3/1983 | Granlund | 62/457.2 |
| 4,407,133 | 10/1983 | Edmonson | 62/3.6 |
| 4,671,070 | 6/1987 | Rudick | 62/3.6 |
| 4,738,364 | 4/1988 | Yeager | 206/563 |
| 5,029,446 | 7/1991 | Suzuki | 62/3.6 |
| 5,365,739 | 11/1994 | Fetterly | 62/3.62 |
| 5,390,791 | 2/1995 | Yeager | 206/438 |
| 5,405,012 | 4/1995 | Shindler et al. | 206/569 |
| 5,483,799 | 1/1996 | Dalto | 62/3.7 |

OTHER PUBLICATIONS

Comtrad Industries, "Tech Update", vol. 2, No. 3, 1996, pp.1,2 and 22.

*Primary Examiner*—William Doerrler

*Attorney, Agent, or Firm*—Pearne, Gordon, McCoy & Granger LLP

[57] ABSTRACT

A personal manually portable thermoelectric-cooling medicine kit, particularly for insulin, is provided. The medicine in the kit is cooled by a Peltier heat pump. The vials of medicine inside the kit are tilted to maximize heat transfer efficiency when the kit is either upright or laid flat. A cap is provided to shield an insulin vial from UV radiation while the case is open and the person is preparing for an injection. The kit includes components which are Velcro-attached to the lining of the kit.

12 Claims, 2 Drawing Sheets

Fig.1
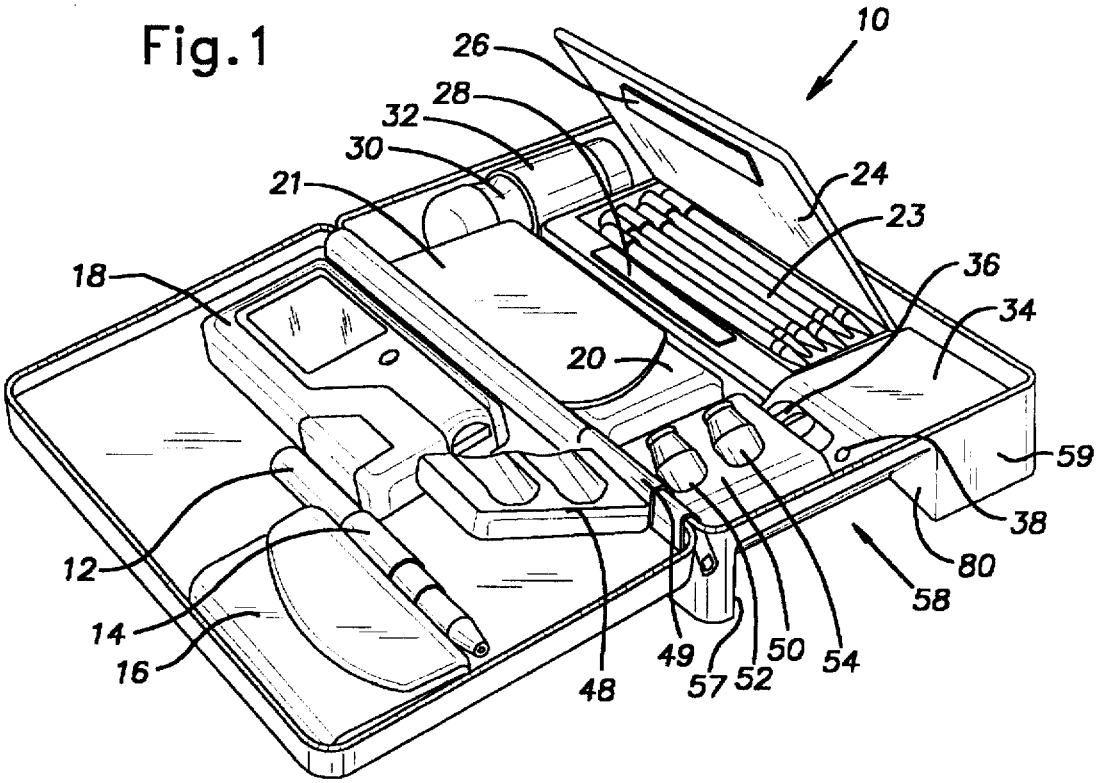
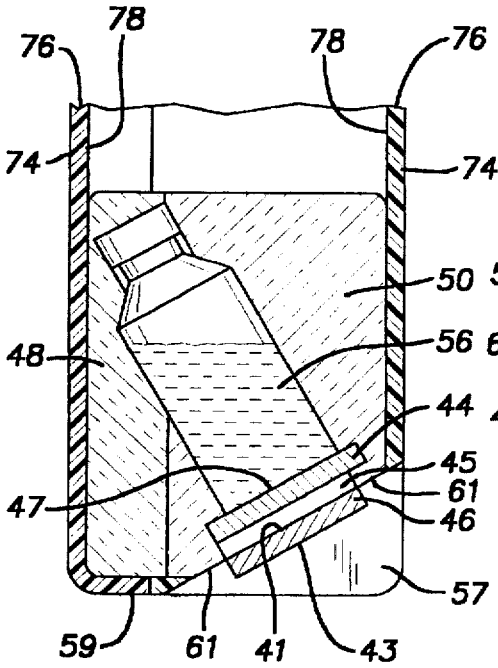
Fig.3
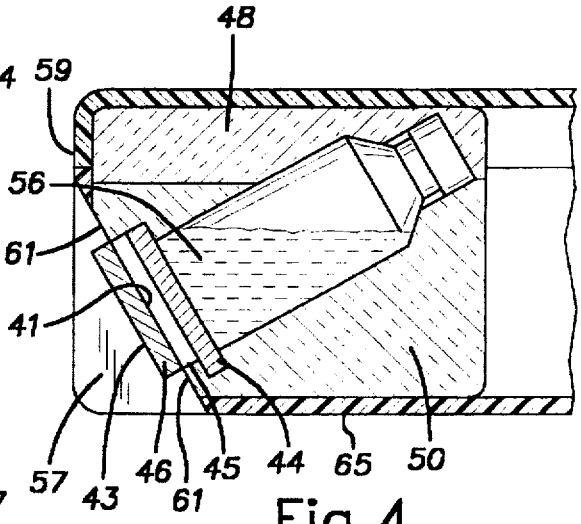
Fig.4

THERMOELECTRIC MEDICINE COOLING BAG

BACKGROUND OF THE INVENTION

This invention relates generally to a portable medicine carrying case and more particularly to a thermoelectric medicine cooling bag.

DESCRIPTION OF RELATED ART

Many medications which are prescribed to be taken on a daily or regular basis must be kept in a controlled-temperature environment. Such medications include insulin, antibiotics reconstructed in sterile water, allergy and other serums, vaccines, suppositories, snake anti-venom, and many others. If the temperature of such substances is not carefully controlled, they lose their stability and potency, and may in fact present health hazards. For example, insulin which is currently available must be maintained at 34° F.–86° F.; the insulin becomes unsafe for use if permitted to warm to a temperature above 86° F.

Heretofore, refrigerated containers have been available for preserving insulin and other similar medications during travel. However, most such devices have in the past merely been passive insulated containers filled with blocks of ice or frozen gel packs which are refreezable in a freezer compartment of a refrigerator. Active devices have been suggested, but they are generally complex, expensive, and lack the features of the present invention. The contents of U.S. Pat. Nos. 3,148,515; 3,713,302; and 4,407,133 are expressly incorporated by reference.

Accordingly, there is a need for a portable thermoelectric medicine cooling bag which is simple in design and construction yet effective in performance and which contains the features of the present invention, including a cap to protect insulin vials from sunlight and ultraviolet radiation while the diabetic kit is open.

SUMMARY OF THE INVENTION

A personal manually portable thermoelectric-cooling medicine kit is provided. The kit comprises a portable box-like case being capable of being opened, the case having a bearing face. A thermoelectric heat pump effective for cooling a vial of medicine is mounted in the case. The heat pump has a cold plate and a heat sink. A source of portable electric power is mounted in the case and is electrically connected to the heat pump. Mounted in the case is a container having a cavity effective for receiving a vial of insulin, the cavity having a longitudinal axis, the longitudinal axis being in angled relationship with the bearing face. Other embodiments of the invention are also disclosed.

BRIEF DESCRIPTION OF THE DRAWINGS

FIG. 1 is a perspective view of a thermoelectric medicine cooling bag.

FIG. 3 is a sectional view of the insulin vial-containing portion of the bag of FIG. 1, the bag being closed and standing upright on bearing face 59.

FIG. 4 is a sectional view as in FIG. 3, but with the bag laying flat on bearing face 65.

DETAILED DESCRIPTION OF THE PREFERRED EMBODIMENTS

Figure 2:
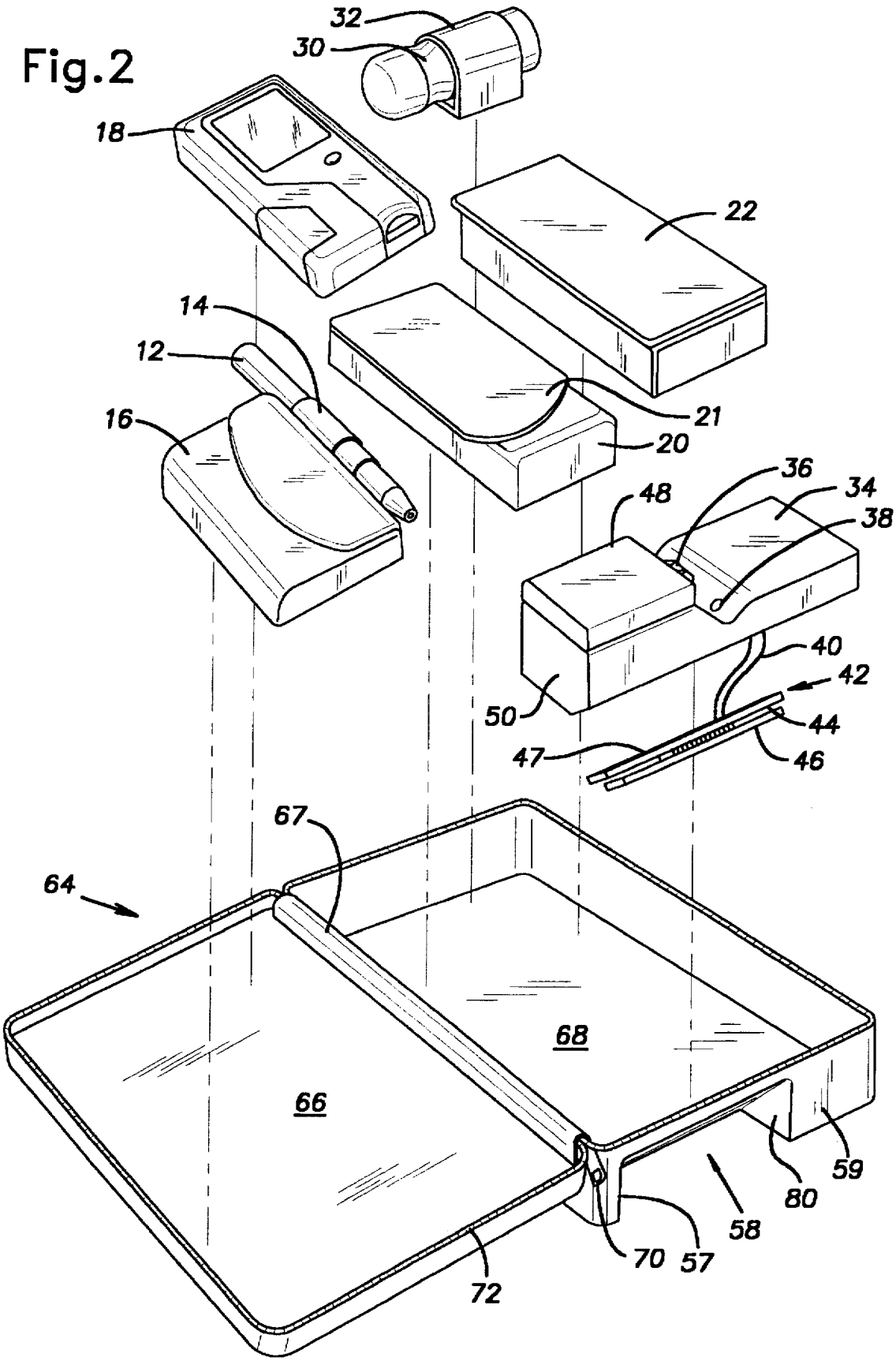
FIG. 2 is an exploded view of the cooling bag of FIG. 1.

With reference to FIGS. 1–4, there is shown a personal, manually portable thermoelectric medicine cooling bag or kit 10 including an outer case or portable box-like case or clam shell bag 64. A box-like case typically has six faces or flat surfaces which are parallel or perpendicular to one another, although a box-like case may have two flat faces and be shaped like a cylinder, or may have just one flat face, or may have another number of faces. The outer case 64 includes an upper half 66 and a lower half 68 joined by a central hinge 67. The outer case is a flexible, self-supporting laminate (see FIG. 3) having washable nylon fabric 74 on the outside, an insulating foam, preferably ¼ inch closed cell foam, core 76, and washable tricot fabric lining 78 on the inner surface. The tricot fabric acts like fuzzy cloth, that is, it acts like the loop portion of a hook and loop Velcro fastener. As will be described hereinafter, most or all of the components of the kit are secured and held in position inside the kit by Velcro fastening means.

The thermoelectric-cooling medicine kit 10 is shown as configured for carrying insulin (which is preferable) and related components or accessories useful or necessary for the injection or administration of insulin. If the kit is used for carrying other medications, other accessories or components useful therewith may be incorporated into the kit in a similar manner. Configured for insulin, the kit 10 includes a number of components, including a spring-loaded lancet unit 12 held in place by a sleeve 14 which has a Velcro hook surface on its underside to adhere to the tricot liner or lining 78. A container 16 holding lancets, a blood glucose testing meter 18, a sleeve 21, a container 22, and a sleeve 32 all have Velcro hook portions on their undersurface to adhere by hook and loop fastening means to the tricot liner. These components less preferably may be held in place by sleeves or bands or other means permanently attached to the case. The sleeve 21 holds container 20 which holds insulin and glucose tablets, alcohol swabs, cotton balls, and related diabetic accessories. Container 22 holds a supply of syringes 23 with needles. The container 22 has a lid 24 closable by corresponding Velcro hook and loop strips 26, 28. Container 30, which holds test strips for use with the glucose testing meter, is held in place by sleeve 32. Other useful components may also be installed. All these components are useful in the administration of medicine to a person.

Container 34 holds two batteries (not shown, preferably "C" cells) as a source of portable electric power. Vial-holding container or base 50 is shown having two cavities for holding two insulin vials; it may have any number of vial-holding cavities, preferably 1–3. There are three grades of insulin; thus, it is an advantage to have 3 vial-holding cavities. The cavity is shown as having a shoulder; alternatively the shoulder may be eliminated and the cavity enlarged and in the form of two coaxial cylinders. Base 50 is shown in FIG. 2 as being joined with container 34; alternatively, they may be separate units. Base 50 is made of an insulating material, such as closed-cell foam or foam rubber. The batteries are electrically connected to a thermoelectric Peltier heat pump 42 by wires 40. Peltier heat pumps are known in the art. A Peltier heat pump is a solid state device which acts like a miniature electrically-operated refrigerator; it has a cold plate for cooling and a corresponding hot plate or heat sink. The Peltier heat pump has a cold plate 44 (having a substantially flat upper face or surface 47) and a heat sink or hot plate 46 joined by Peltier junction or module or connector 45. Heat sink 46 has a top surface 41 and a bottom surface 43. The bottom surface (which is substantially flat) of each vial is parallel with and in direct physical contact with the surface 47 of the cold plate 44 as shown. The Peltier heat pump is controlled by an on/off switch 36 and conventional circuitry. An LED indicator light 38 glows solid when electricity is flowing (indicating the heat pump is actively cooling) and blinks when the battery is low. The blinking overrides the glowing when the two are in conflict. Optionally, rechargeable batteries may be used, or a connector (not shown) may be added to permit connection to an external power source, such as AC or DC electrical power.

Insulating cap 48 swings into position via hinge 49 to insulate medicine or insulin vials 52 and 54 and to shield them from sunlight and other ultraviolet radiation while the kit is open. Cap 48, which may be removably attached to hinge 49, is made of an insulating material, such as closed-cell foam or foam rubber. Hinge 49 may be removably attached to hinge 67. Optionally, there may be a separate cap for each vial. The battery container 34, the base 50 and the heat pump 42 may be removably attached to the lower half 68 of the case 64 by Velcro means, straps or other attachment means, or may less preferably be permanently attached.

The case 64 has a bearing face 59 and a bearing face 65, these faces being adjoining. A bearing face is a face which bears the weight of the case when the case is sitting on that face. As can be seen in the Figures, bearing face 59 has a portion cutaway (a cutaway portion) and bearing face 65 has a cutaway portion, these two cutaway portions being adjoining or merging to define a portion (shown by arrow 58) of case 64 being cutaway, the portion of case 64 being cutaway being defined by ends 57 and 80. This cutaway portion of case 64 may extend the entire length of face 59, with no ends, to increase air circulation to the heat sink. The portions are cutaway to increase air circulation to the heat sink 46 to dissipate heat therefrom. As can be seen in the Figures, when the kit is closed and either bearing face 59 or bearing face 65 is placed on a flat surface, atmospheric or ambient air may communicate and circulate through one of the cutaway portions directly and unimpeded with the heat sink 46 to dissipate heat therefrom. As shown in FIG. 3, at least some and preferably most or all of heat sink 46 projects out from and away from the portion of the kit which surrounds or abuts or is adjacent the heat sink 46, to increase dissipation or discharge of heat, the surrounding or abutting portion of the kit being defined by surface 61. Each half 66, 68 of the case 64 has zipper teeth 72 on three sides so that the case 64 may be closed by zipper handle 70.

The Peltier heat pump unit has a thermostat preset to preferably 70°–75°F. so that when the unit is turned on, the heat pump will not permit the insulin or other medication to exceed a preselected temperature; for example the thermostat may be set so that the insulin is not permitted to exceed, and is maintained at or below, 75° F. This is satisfactory for current insulin, which for safety should be maintained at less than 86° F.

In use, the diabetic opens up the kit to prepare for an injection. The spring-loaded lancet unit, test strips, and glucose testing meter are used to determine glucose levels and how much insulin is needed. It is important that the cap 48 be left in place covering the vials while the kit is open and the testing is being done (typically 5–10 minutes) in order to keep the vials cool and block sunlight and ultraviolet light from striking the medication; ultraviolet light deteriorates insulin and this should be avoided. Once the necessary amount of insulin is determined, the cap 48 is swung or biased to an open position, an appropriate amount of insulin is removed from the vial into the syringe, the cap 48 is swung closed, and the injection is administered. The various accessories are then put back and the case is closed.

In connection with the testing and injection procedure, drops of blood may drop into the kit, for example, onto the tricot fabric lining 78. For this reason, the components, as described, are attached by Velcro means and are thus removable and are also replaceable. As necessary, the components may be removed from the case 64, and the case may be washed to wash out the blood stains. The components may then be re-Velcro attached inside the case.

As shown in FIG. 3, the surfaces of the Peltier heat pump are sloped so that the vial of medication is maintained at an angle from the vertical. In FIG. 3 the cavity containing the vial has a longitudinal axis coincident with the central longitudinal axis running down the center of the vial. The longitudinal axis of the cavity is tilted and in angled relationship (i.e., neither parallel nor perpendicular) with the bearing face 59. In FIG. 3 this angle is 60°. In FIG. 4 the angle between the cavity longitudinal axis and bearing face 65 is 30°. In FIG. 3 the vial is maintained at a 30° angle from the vertical. This angle is preferably about 30°, less preferably 25°–35°, less preferably 20°–40°, less preferably 15°–45°, less preferably 35°–55°, less preferably 30°–60°, less preferably at least 10°, less preferably at least 5°. If the vial of insulin or other medication were oriented vertically in FIG. 3 as in the prior art, when the case is laid flat, some of the bottom surface of the vial would not be covered by liquid (unless the vial is completely filled), resulting in a portion of the bottom surface of the vial being cooled by the heat pump but not being covered by liquid to benefit from the cooling. When the vial is angled as in the present invention, whether the case is oriented vertically (FIG. 3) or horizontally (FIG. 4), the liquid 56 in the vial will more frequently cover the entire bottom surface of the vial, thus maximizing the contact surface and accordingly maximizing heat transfer efficiency between liquid in the vial and the cold plate 44 of the heat pump 42. Particularly when the case is laid flat on bearing face 65, the angle of the vial will keep more insulin against the cooling surface.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed:

1. A personal manually portable thermoelectric-cooling medicine kit comprising a portable box-like case, said case being capable of being opened, said case having a bearing face, a thermoelectric heat pump mounted in said case effective for cooling a vial of medicine, said heat pump having a cold plate and a heat sink, a source of portable electric power mounted in said case and being electrically connected to said heat pump, a container mounted in said case having a cavity effective for receiving a vial of insulin, said cavity having a longitudinal axis, said longitudinal axis being in angled relationship with said bearing face.

2. A medicine kit according to claim 1, the angle between said longitudinal axis and said bearing face being about 20°–40°.

3. A medicine kit according to claim 1, said cold plate having a substantially flat upper face, said cavity being configured so that when a vial of insulin having a substantially flat bottom is mounted therein, said bottom is parallel with and in direct physical contact with said upper face.

4. A medicine kit according to claim 1, said kit having a first bearing face having a first cutaway portion and a second bearing face having a second cutaway portion, said first bearing face and said second bearing face being adjoining, said first cutaway portion and said second cutaway portion being adjoining such that when said kit is closed and a bearing face selected from the group consisting of said first bearing face and said second bearing face is placed on a flat surface, atmospheric air may communicate through a cutaway portion selected from the group consisting of said first cutaway portion and said second cutaway portion directly with said heat sink to dissipate heat therefrom.

5. A medicine kit according to claim 4, a portion of said kit surrounding said heat sink, said heat sink projecting out from said portion surrounding said heat sink.

6. A medicine kit according to claim 1, a vial of insulin mounted in said cavity, said case having mounted therein a plurality of components useful in the administration of insulin to a person.

7. A medicine kit according to claim 6, said container mounted in said case having at least two cavities, each cavity effective for receiving a vial of insulin.

8. A medicine kit according to claim 7, said container having at least three cavities, each cavity effective for receiving a vial of insulin.

9. A medicine kit according to claim 1, further comprising a cap mounted in said case effective, while in a first position, to shield a vial of insulin stored in said cavity from ultraviolet radiation while said case is open, said cap biasable to a second position to permit said vial of insulin to be removed from said cavity.

10. A medicine kit according to claim 1, said case having a lining, said case having removable mounted therein a plurality of components useful in administration of medicine to a person, said components being removable attached to said lining of said case by hook and loop fastening means.

11. A medicine kit according to claim 10, said lining being washable such that said components may be removed and blood stains in said lining may be washed out of said lining.

12. A medicine kit according to claim 11, said case having an exterior, said exterior being of flexible and insulated material.

* * * * *